US012203263B2

(12) United States Patent
Snook

(10) Patent No.: US 12,203,263 B2
(45) Date of Patent: Jan. 21, 2025

(54) DEVICE TO ELEVATE A BASE PLATE

(71) Applicant: Donald Snook, Ottawa (CA)

(72) Inventor: Donald Snook, Ottawa (CA)

( * ) Notice: Subject to any disclaimer, the term of this patent is extended or adjusted under 35 U.S.C. 154(b) by 70 days.

(21) Appl. No.: 17/463,555

(22) Filed: Sep. 1, 2021

(65) Prior Publication Data

US 2023/0065534 A1 Mar. 2, 2023

(51) Int. Cl.

| | |
|---|---|
| ***E04B 1/64*** | (2006.01) |
| ***E04C 3/07*** | (2006.01) |
| ***E04C 3/28*** | (2006.01) |
| *E04B 2/56* | (2006.01) |

(52) U.S. Cl.

CPC ..... *E04B 1/64* (2013.01); *E04C 3/07* (2013.01); *E04C 3/28* (2013.01); *E04B 2/56* (2013.01)

(58) Field of Classification Search

CPC ..... E04B 1/64; E04B 2/56; E04C 3/07; E04C 3/28

USPC ..... 52/169.5, 302.1

See application file for complete search history.

(56) References Cited

U.S. PATENT DOCUMENTS 1,924,986 A * 8/1933 Frazier ..... E04B 2/62 24/336
2,105,588 A * 1/1938 Davis ..... E04B 2/825 52/601
2,540,305 A * 2/1951 Tomlinson ..... E04B 2/7401 52/349
2,645,824 A 7/1953 Titsworth
3,481,090 A 12/1969 Leo
3,949,827 A * 4/1976 Witherspoon ..... E04B 2/7437 52/239
4,586,305 A * 5/1986 Balinski ..... E04B 2/825 52/302.1
5,501,044 A * 3/1996 Janesky ..... E04B 1/7023 52/287.1
5,535,556 A * 7/1996 Hughes, Jr. ..... E04B 1/7023 52/293.3
5,836,135 A 11/1998 Hagan et al.
5,901,514 A * 5/1999 Wolfe ..... E04B 2/82 52/287.1
6,550,190 B2 * 4/2003 Ruiz ..... E04B 1/7023 52/302.1
6,619,001 B1 * 9/2003 Pratt ..... E02D 31/02 52/302.1
6,742,758 B2 * 6/2004 Janesky ..... E04G 9/05 404/93
7,313,891 B2 * 1/2008 Showers ..... E04B 1/7069 52/270
8,161,705 B2 * 4/2012 Pratt ..... E04F 19/066 52/506.01
8,631,617 B2 * 1/2014 Janesky ..... E04F 19/064 52/282.1
8,689,507 B2 * 4/2014 Chandler ..... E02D 31/02 52/287.1

(Continued)

*Primary Examiner* — Brian E Glessner
*Assistant Examiner* — Adam G Barlow

(57) ABSTRACT

Illustrated views of an exemplary elevated base plate for elevated a base plate from a concrete floor such as a basement, slab, etc. is presented. The elevated base plate is useful preventing leakage or other water from coming into contact with wood, drywall, paneling, etc. forming a wall. The elevated base plate is further useful for allowing a better air flow around the wall and base plate. Further, the elevated base plate 100 is useful for preventing or controlling the growth of mold.

10 Claims, 4 Drawing Sheets

(56) References Cited

U.S. PATENT DOCUMENTS

| | | | | |
|---|---|---|---|---|
| 10,487,497 | B1 | 11/2019 | Aitken | |
| D946,950 | S * | 3/2022 | Siekmann | D6/702 |
| 2002/0121052 | A1* | 9/2002 | Olink | E01C 11/221 47/33 |
| 2006/0026911 | A1 | 2/2006 | Sutton | |
| 2007/0163191 | A1 | 7/2007 | Berry | |
| 2008/0190045 | A1* | 8/2008 | Janesky | E02D 31/02 52/169.5 |
| 2008/0295439 | A1* | 12/2008 | Janesky | E04F 19/06 52/589.1 |
| 2012/0060433 | A1* | 3/2012 | Chandler | E02D 31/02 52/302.1 |
| 2012/0180818 | A1* | 7/2012 | Janesky | E02D 31/02 52/302.3 |
| 2013/0036691 | A1* | 2/2013 | Janesky | E02D 31/02 52/302.1 |
| 2016/0069071 | A1* | 3/2016 | Remmele | E04B 1/765 52/302.1 |
| 2019/0301180 | A1* | 10/2019 | Dutil | E04G 11/46 |
| 2020/0095767 | A1* | 3/2020 | Attalla | E04C 3/32 |
| 2021/0172163 | A1* | 6/2021 | Sawada | E04B 1/5818 |

* cited by examiner

DEVICE TO ELEVATE A BASE PLATE

FIELD OF THE INVENTION

This invention relates to wall construction. More particularly, it relates to a device to elevate a base plate for wall construction.

BACKGROUND

A basement or cellar is one or more floors of a building that are completely or partly below the ground floor. It generally is used as a utility space for a building, where such items as the boiler, water heater, breaker panel or fuse box, car park, and air-conditioning system are located; also, amenities such as the electrical distribution system and cable television distribution point. In cities with high property prices basements are often fitted out to a high standard and used as living space.

In the case of a fully finished basement, the space has been designed, either during construction or at a later point by the owners, to function as a fully habitable addition to the house. Frequently most or all of the basement is used as a recreation room or living room, but it is not uncommon as well to find there (either instead of or alongside the living/recreation room) a guest bedroom or teenager's room, a bathroom, a home office, a home gym, a home theater, a basement bar, a sauna, and one or more closets. Occasionally a part of the basement is unfurnished and is used for storage, a workshop, and/or a laundry room; when this is the case the water heater and furnace will also often be located there, although in some cases the entire basement is finished, and the water heater and furnace are boxed off into a closet.

A partially finished basement, which also might be called "half-finished", is likely used by teenagers and children. The entire family might utilize a work-out area. It is also common to have a secondary (or primary) home office in a partially finished basement, as well as a workbench and/or a space for laundry appliances. Toilets and showers sometimes exist in this variety of basement, as many North American basements are designed to allow for their installation.

Even with functioning sump pumps or low water tables, basements may become wet after rainfall, due to improper drainage. The ground next to the basement must be graded such that water flows away from the basement wall. Downspouts from roof gutters should drain freely into the storm sewer or directed away from the house. Downspouts should not be connected to the foundation drain tiles. If the drain tiles become clogged by leaves or debris from the rain gutters, the roof water would cause basement flooding through the drain tile. Damp-proofing or waterproofing materials are typically applied to outside of the basement wall. It is virtually impossible to make a concrete wall waterproof, over the long run, so drainage is the key. There are draining membranes that can be applied to the outside of the basement that create channels for water against the basement wall to flow to the foundation drains.

However, water in a basement occurs frequently. Walls are built most often using a base plate, but the base plate is set on the concrete floor of the basement or on concrete slabs. When water encroaches into the basement or any concrete flooring, any walls that are built can soak up the water causing damage to the drywall and, in a best-case scenario, can be dried out to save the wall.

Accordingly, an in light of the foregoing, there is a need for a device which can be used as a base plate when building a wall which will reside on a concrete base, such as in a basement.

DETAILED DESCRIPTION

Figure 1A:
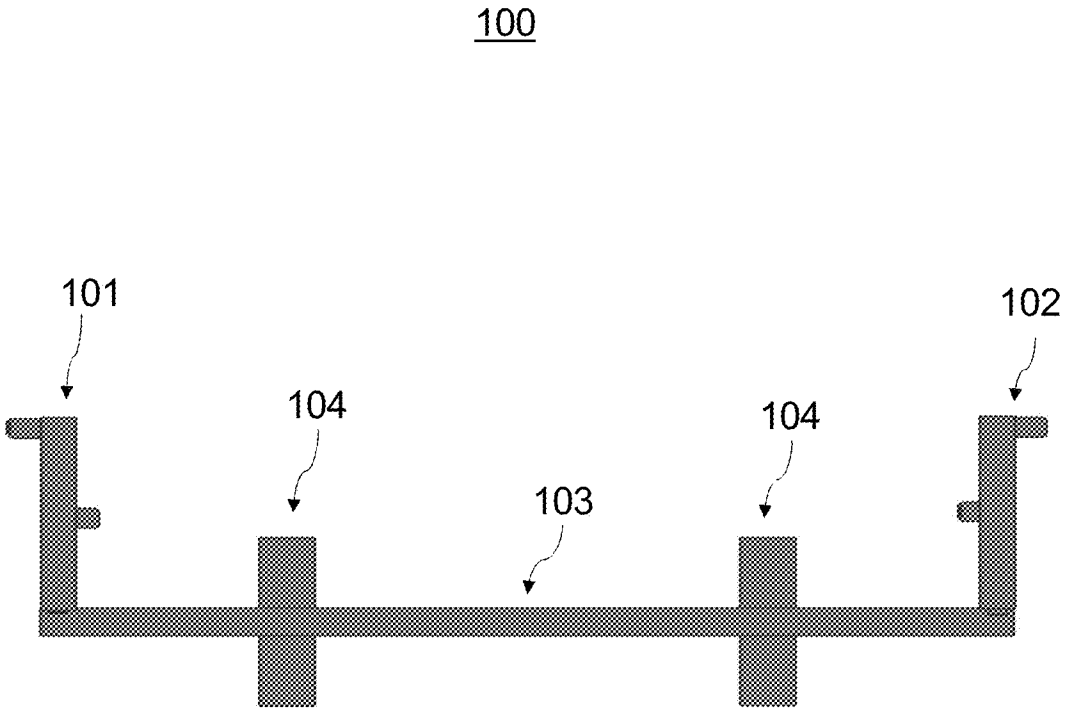
FIG. 1A is an illustrated view of an exemplary base plate elevation device.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Figure 1B:
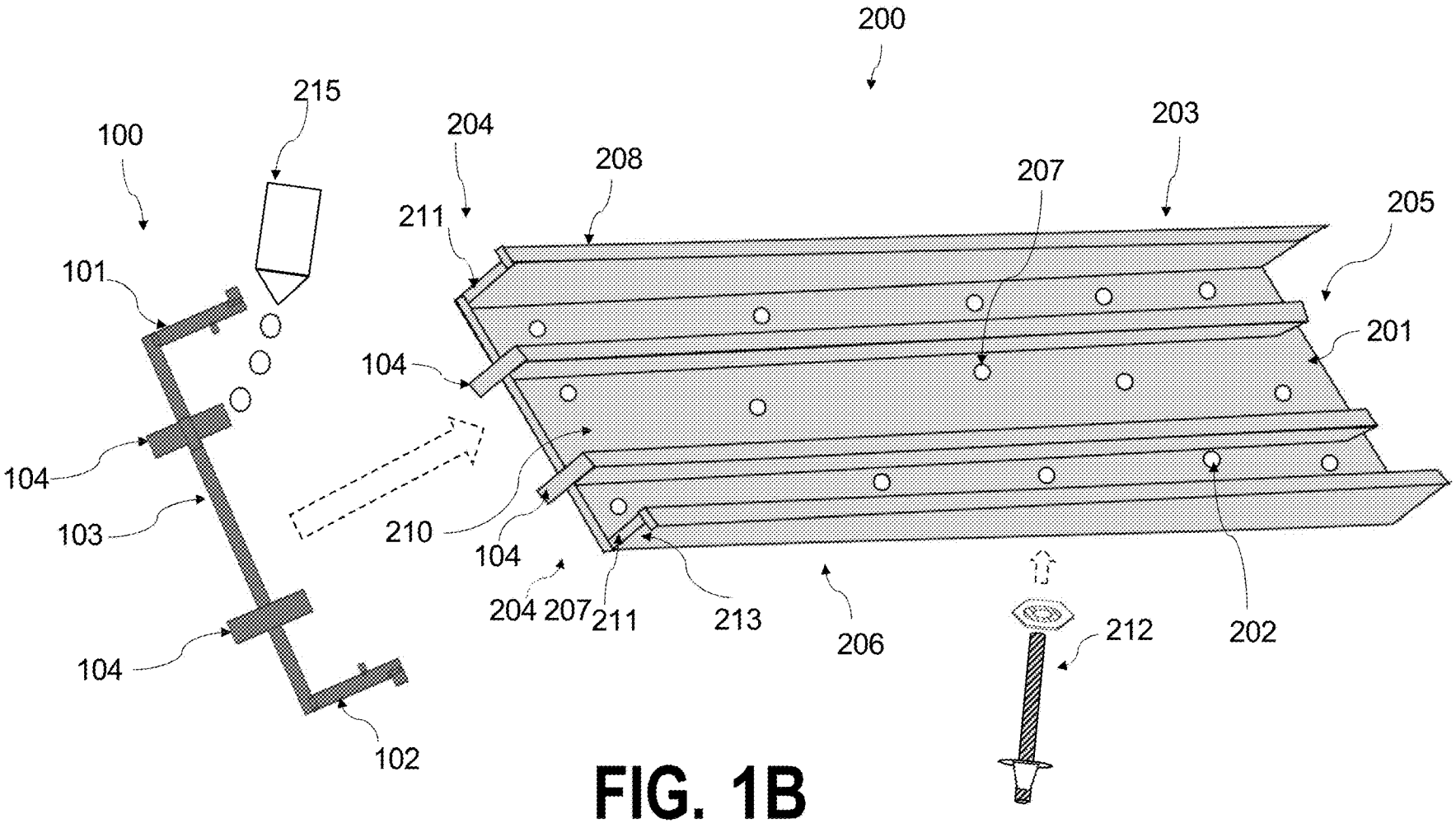
FIG. 1B is an illustrated view of a bottom of a base plate with the base plate elevation device shown in FIG. 1A.

Referring to FIG. 1A and FIG. 1B, illustrated views of an exemplary elevate base plate device 100 for elevated a base plate from a concrete floor such as a basement, slab, etc. is presented. The elevated base plate 100 is useful preventing leakage or other water from coming into contact with wood, drywall, paneling, etc. forming a wall. The elevated base plate 100 is further useful for allowing a better air flow around the wall and base plate 100. Further, the elevated base plate 100 is useful for preventing or controlling the growth of mold.

The elevated base plate device 100 is preferably made out of a plastic material, such as poly-vinyl chloride (PVC), etc., however other types of material are hereby contemplated, including, but not limited to, steel, aluminum, titanium, etc.

A base plate 200 has a top 201, a right side 202, a left side 203, a front side 204, a back side 205 and a bottom 206. The top 201 has a plurality of holes 207 and railings 208. The railings 208 provide additional support for a framing (see FIG. 1C). The holes 207 provide for drainage of water and can be utilized to couple the base plate 200 to a concrete floor by a concrete connector 212. The right side 202 and the left side 203 are coupled to the top 201 of the base plate 200 and extend a desired and predetermined height.

The top 201 of the base plate 200 is configured to encapsulate the framing material for the wall between the right side 202 of the base plate 200 and the left side 203 of the base plate 200.

The railings 208 are coupled to a floor 210 of the top 201 of the base plate 200. The railings 208 are extended to a great height than the floor 210 of the top 201. Each of the railings 208 further have a front panel 211. The front panel 211 is configured to be even with the front side 204 of the base plate 200. Although the back side 208 is not shown, the railings 208 are identical to the description of front panel 211 of the railings 208.

In FIG. 1B, the bottom 206 is significantly flat and may be coupled to or not coupled to a concrete floor. The bottom 206 further has the same holes 207 as the top 201 of the base plate 200.

The elevated base plate device 100 has a first post 101, a second post 102, a stabilizing post 103 and a plurality of legs 104. The elevated legs 104 are coupled to the front panels 211 by a coupler 215, such that the elevated base plate device 100 is securely coupled to the base plate 200.

The first post 101 and the second post 102 are coupled to a front 213 of the right side 202 and a front 204 the left side 203 by the coupler 215. Again, the back side 205 is identical in description as the front side 204 and is not described separately in this application.

The coupler 215 is preferably a construction glue material, however other types of couplers is hereby contemplated, including, but not limited to, two-side tape, clamps, etc. The coupler 215 is preferably a construction glue material, however other types of couplers is hereby contemplated, including, but not limited to, two-side tape, clamps, etc.

The legs 104 of the elevated base plate device 100 are configured to elevate or lift the base plate 200 off of the concrete floor to allow air to flow thus reducing mold and prevent the base plate 200 from being on the concrete floor if the basement were to flood.

Figure 1C:
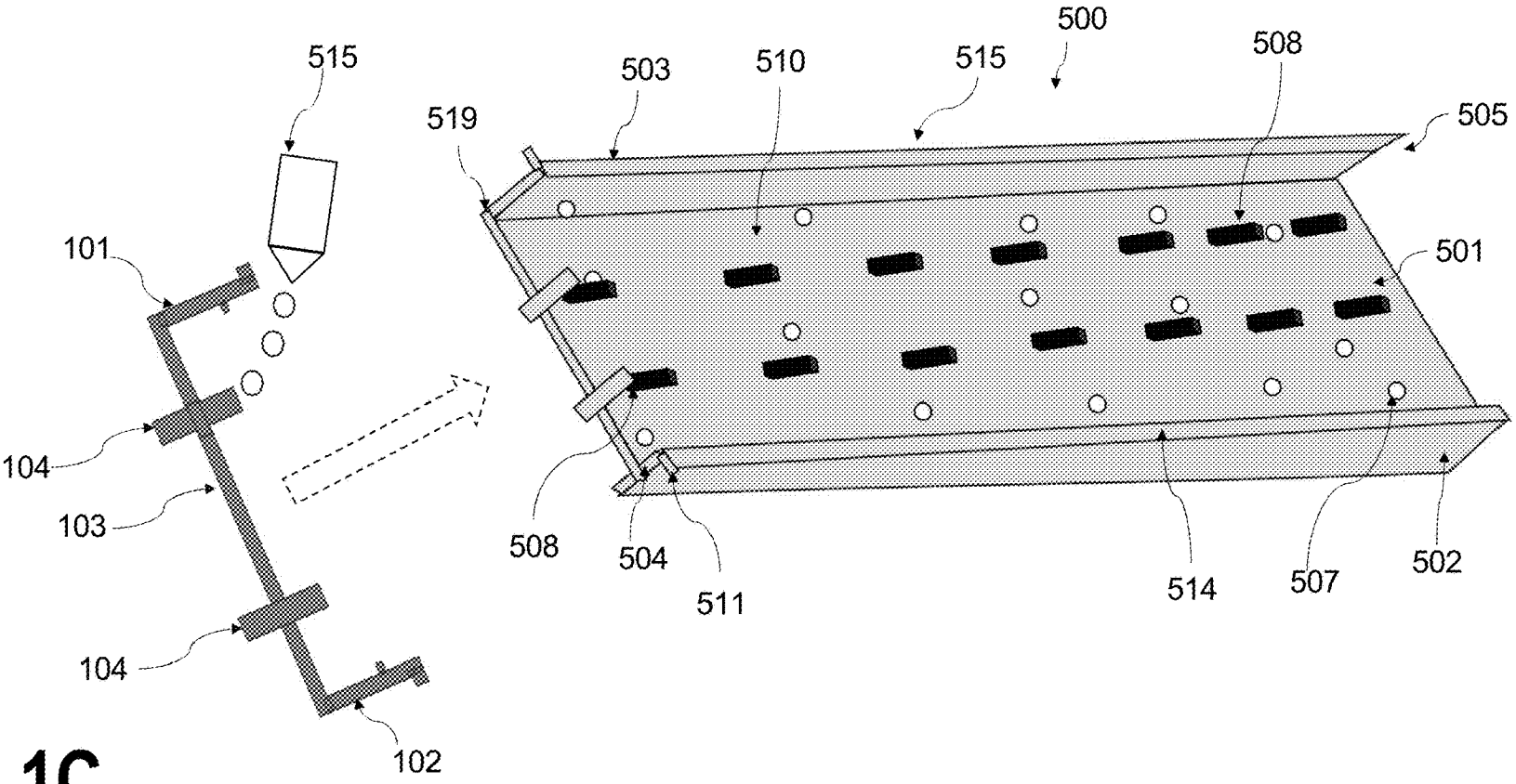
FIGS. 1C and 1D are illustrated views of a second embodiment of an elevated base plate shown in FIG. 1A.
Figure 1D:
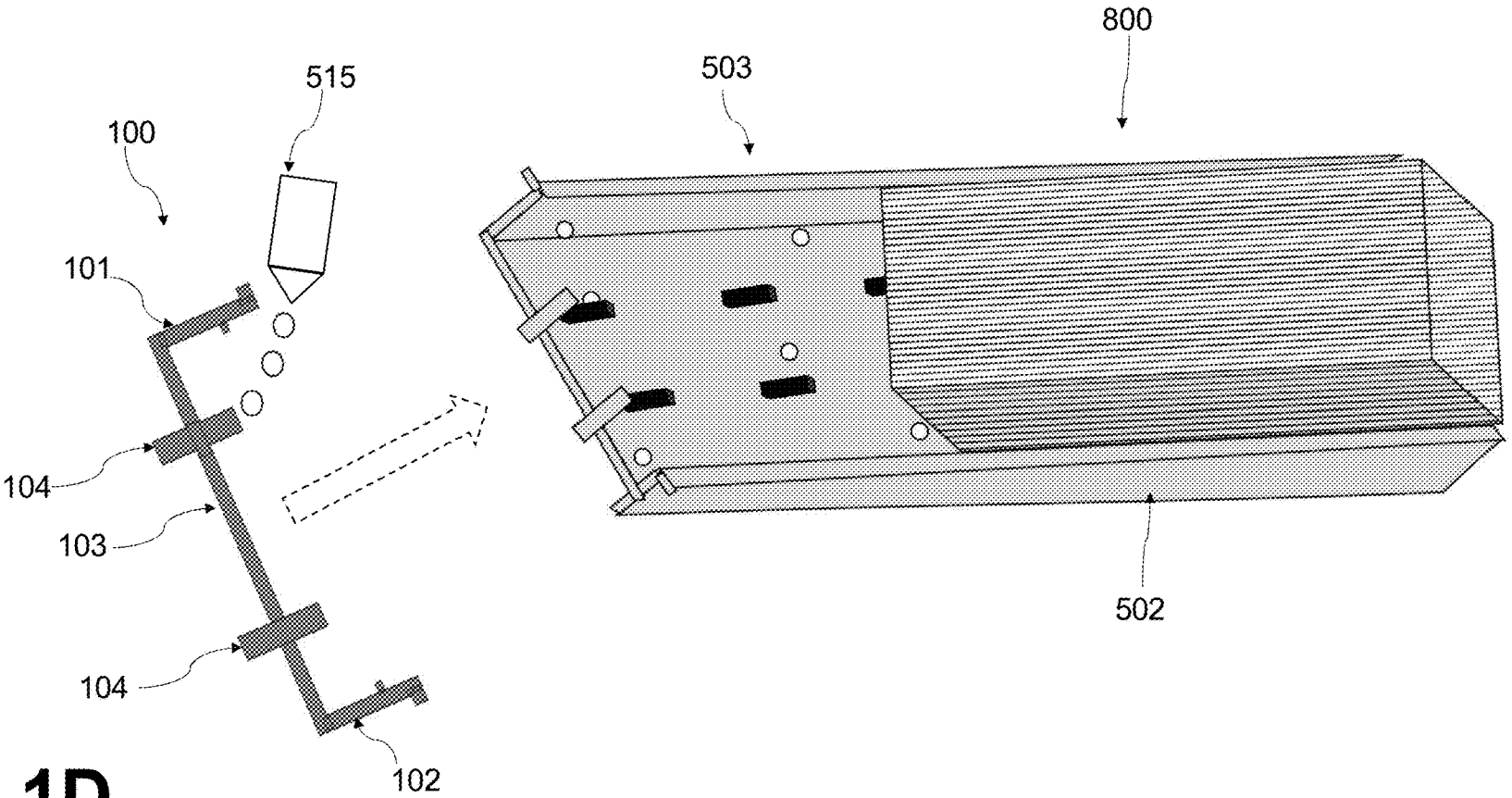

Moving now to FIG. 1C and FIG. 1D and FIG. 1E, an illustrated use of a second embodiment of the elevated base plate 100 shown in FIG. 1A is presented shown in FIG. 1A are presented.

In FIG. 1C, the elevated base plate device 500 is preferably made out of a plastic material, such as poly-vinyl chloride (PVC), etc., however other types of material are hereby contemplated, including, but not limited to, steel, aluminum, titanium, etc.

A base plate 500 has a top 501, a right side 502, a left side 503, a front side 504, a back side 505 and a bottom 506. The top 501 has a plurality of holes 507, a plurality of protrusions 508. The front side 504 of the base plate 500 has one or more front panels 511, 519. The protrusions 508 provide additional support for a framing (see FIG. 1C, FIG. 1D and FIG. 1E). The holes 507 provide for drainage of water and can be utilized to couple the base plate 500 to a concrete floor by a concrete connector 512. The right side 502 and the left side 503 are coupled to the top 501 of the base plate 500 and extend a desired and predetermined height.

The top 501 of the base plate 500 is configured to encapsulate the framing material for the wall between the right side 502 of the base plate 500 and the left side 503 of the base plate 500.

The protrusions 508 are coupled to a floor 510 of the top 501 of the base plate 500. The protrusions 508 are extended to a great height than the floor 510 of the top 501. The protrusions 508 are preferably arranged in a line where the protrusions 508 are equally spaced apart and preferably in two (2) lines. However, the protrusions may be arranged in a random or semi-random alignment on the top 501 of the base plate 500. The protrusions further may be arranged not in a line or in one or more lines as desired. The front panels 511, 519 are configured to be even with the front side 504 of the base plate 500. The right side 502 and the left side 503 each has a railing 514, 516. Although the back side 508 is not shown, one or more back panels (not shown) are identical to the description of front panels 511, 519 of the railings 514, 516.

The elevated base plate device 100 has a first post 101, a second post 102, a stabilizing post 103 and a plurality of legs 104. The elevated legs 104 are coupled to the front panels 511, 519 by a coupler 515, such that the elevated base plate device 100 is securely coupled to the base plate 500.

The first post 101 and the second post 102 are coupled to a front 513 of the right side 502 and a front 504 the left side 503 by the coupler 515. Again, the back side 505 is identical in description as the front side 504 and is not described separately in this application.

The coupler 515 is preferably a construction glue material, however other types of couplers is hereby contemplated, including, but not limited to, two-side tape, clamps, etc. The coupler 515 is preferably a construction glue material, however other types of couplers is hereby contemplated, including, but not limited to, two-side tape, clamps, etc.

The legs 104 of the elevated base plate device 500 are configured to elevate or lift the base plate 500 off of the concrete floor to allow air to flow thus reducing mold and prevent the base plate 500 from being on the concrete floor if the basement were to flood.

Finally, FIG. 1D presents a framing board 800, in this case the framing board 800 is a 4×4, however any other size framing board 800 will be acceptable for working with the base plate 500 with the elevated base plate device 500. The framing board 800 is configured and placed between the right side 502 of the base plate 500 and the left side 503 of the base plate 500.

The elevated base plate device 100 has a first post 101, a second post 102, a stabilizing post 103 and a plurality of legs 104. The elevated legs 104 are coupled to the front panels 511, 519 by a coupler 515, such that the elevated base plate device 100 is securely coupled to the base plate 500.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An elevated base plate device for reducing damage to walls of a basement and to be set on concrete slabs for security of a base plate, the device consisting of:

a base plate, the base plate comprising:

a first end, a second end, a top, a floor, a plurality of railings, a right side and a left side;

the railings being coupled to the floor of the top of the base plate;

a plurality of front panels, one of the front panels being coupled to a front of the right side of the base plate, a second of the front panels being coupled to a front the left side at the front of the base plate, a third of the front panels being coupled to a back of the right side at the back of the base plate, a fourth of the front panel being coupled to a back of the left side at the back of the base plate; and a bottom;

one or more couplers, wherein the couplers being a concrete glue material;

a first post, the first post being coupled to one of the front panels;

a second post, the second post being coupled to one of the front panels;

a stabilizing post, the stabilizing post being coupled to the first post and the second post;

a plurality of legs, the plurality of legs being coupled to the stabilizing post, wherein each of the plurality of legs being coupled to one of the railings of the base plate by the coupler, wherein the legs being for elevating the base plate above a concrete floor.

2. The device of claim 1, wherein elevated base plate device being made of a steel material.

3. The device of claim 1, wherein elevated base plate device being made of a metal material.

4. The device of claim 1, wherein the floor of the base plate having a plurality of holes.

5. The device of claim 4, wherein the bottom having a plurality of holes, wherein the holes of the bottom of the base plate being the same as the holes of the floor of the base plate.

6. An elevated base plate device for reducing damage to walls of a basement and to be set on concrete slabs for security of a base plate, the device consisting of:

a base plate, the base plate comprising:

a first end, a second end, a top, a floor, a plurality of protrusions, a right side and a left side;

the protrusions being coupled to the floor of the top of the base plate;

a plurality of front panels, one of the front panels being coupled to a front of the right side of the base plate, a second of the front panels being coupled to a front the left side at the front of the base plate, a third of the front panels being coupled to a back of the right side at the back of the base plate, a fourth of the front panel being coupled to a back of the left side at the back of the base plate; and a bottom;

one or more couplers, wherein the couplers being a concrete glue material;

a first post, the first post being coupled to one of the front panels;

a second post, the second post being coupled to one of the front panels;

a stabilizing post, the stabilizing post being coupled to the first post and the second post;

a plurality of legs, the plurality of legs being coupled to the stabilizing post, wherein each of the plurality of legs being coupled to one of the railings of the base plate by the coupler, wherein the legs being for elevating the base plate above a concrete floor.

7. The device of claim 6, wherein elevated base plate device being made of a plastic material.

8. The device of claim 6, wherein elevated base plate device being made of a steel material.

9. The device of claim 6, wherein the floor of the base plate having a plurality of holes.

10. The device of claim 6, wherein the bottom having a plurality of holes, wherein the holes of the bottom of the base plate being the same as the holes of the floor of the base plate.

* * * * *